US007871181B2

(12) United States Patent
Fan

(10) Patent No.: US 7,871,181 B2
(45) Date of Patent: Jan. 18, 2011

(54) STRUCTURE OF A COLOR CHANGEABLE SOFT-TUBE LIGHT

(75) Inventor: Ben Fan, Heshan (CN)

(73) Assignee: He Shan Lide Electronic Enterprise Company, Ltd., Heshan (CN)

( * ) Notice: Subject to any disclaimer, the term of this patent is extended or adjusted under 35 U.S.C. 154(b) by 503 days.

(21) Appl. No.: 11/915,104

(22) PCT Filed: May 23, 2005

(86) PCT No.: PCT/CN2005/000707

§ 371 (c)(1),
(2), (4) Date: May 15, 2008

(87) PCT Pub. No.: WO2006/125338

PCT Pub. Date: Nov. 30, 2006

(65) Prior Publication Data

US 2008/0310183 A1 Dec. 18, 2008

(51) Int. Cl.
*F21S 4/00* (2006.01)
*F21V 21/00* (2006.01)
*F21V 7/04* (2006.01)

(52) U.S. Cl. ..... 362/249.02; 362/555

(58) Field of Classification Search ..... 362/555, 362/217.1–217.13, 249.01–249.04
See application file for complete search history.

(56) References Cited

U.S. PATENT DOCUMENTS 6,361,186 B1 3/2002 Slayden
6,648,498 B1 11/2003 Tsao

FOREIGN PATENT DOCUMENTS

CN 1453499 A 11/2003
WO WO2005/017408 A 2/2005

*Primary Examiner*—Sandra L O Shea
*Assistant Examiner*—William J Carter
(74) *Attorney, Agent, or Firm*—Seyfarth Shaw LLP

(57) ABSTRACT

An improved color changeable tube light includes a opaque core line, a plurality of LEDs being arranged in the core line, a translucent diffuser with the same length as the core line, a cladding layer having the same length as the core line and covering the core line and being formed by extrusion molding integrally with the diffuser into one piece. A unit is formed by disposing a red LED, a green LED and a blue LED of the plurality of LEDs into a fixing means, a plurality of the units are connected in series and disposed in the plurality of transversal through-holes of the core line respectively. The fixing means may be a box. The box may be quadrate, round or elliptic in shape. The tube light of the present invention to have the effects of light beams of neon light, and the color changing and the color mixing to obtain various results are available.

8 Claims, 8 Drawing Sheets

STRUCTURE OF A COLOR CHANGEABLE SOFT-TUBE LIGHT

This application is a U.S. National Phase of International Patent Application Serial No. PCT/CN2005/000707 filed May 23, 2005.

BACKGROUND OF THE INVENTION

The present invention relates to a decorative lighting device, and in particular to a color changeable tube light for simulating the effects of successive, even, vivid and soft light beams of the neon light.

The known tube light for simulating the effects of the neon light is provided with transversal through-holes in the core line and LEDs in the transversal through-hole. Though the effects of successive, even, bright-color and soft light beams of the neon light are obtained, the effect of color changeable remains unavailable. In the PCT International Application No. PCT/CN2004/000634 filed by the present applicant, a fixing means for containing a red LED, a green LED and a blue LED and disposing in the transversal through-hole of the core line is not disclosed. If a tube light for simulating the effects of color changeable neon light is designed according to the above international application, a red LED, a green LED and a blue LED should be disposed into three parallel transversal through-holes respectively, and thus the spacing is obviously large, which goes against the scattering and homogenizing of light beams by the diffuser, color mixing and color changing. If the red LED, the green LED and the blue LED are simultaneously disposed in the transversal through-hole, the three LEDs would be dislocated easily for lacking of fixing means, which goes against color mixing, color changing and results in color unevenness of the emission light, and besides the structure is not compact and firm enough, the LED lead wire would be broken easily which lead to bad electrical connection. Therefore, it is an object for the companies in this field to design a tube light for simulating the effects of successive, even, vivid and soft light beams of the neon light, which is capable to change the color and mix the colors of light beams, and is of compact and firm structure, and can be bended freely and cut off or extended if necessary.

SUMMARY OF THE INVENTION

Having outlined the state of the prior art and its attendant shortages, it is an object of the present invention to provide a tube light for simulating the effects of successive, even, bright-color and soft light beams of the neon light, which is capable to change the color and mix the colors of light beams, and is of compact and firm structure, and can be bended freely and cut off or extended if necessary.

The above object of the present invention is achieved by the following technical solutions:

An improved color changeable tube light, comprises:

a core line, the core line being formed of a strip with predetermined length produced by extrusion molding of white opaque flexible plastic, wherein four copper stranded wires are provided vertically at interval in one side portion of the cross section of the strip, two longitudinal through holes are provided at the middle portion of the cross section of the strip, the copper stranded wire is of the same length as that of the longitudinal through hole, a slot is formed longitudinally on the upper side wall of the longitudinal through hole, a plurality of transversal through-holes are arranged at predetermined even interval along the longitudinal length of the strip, each of the transversal through-holes parallel to the copper stranded wire is provided in the central of the strip, a reverse trapezoidal groove is provided on the upper side wall of the strip;

a plurality of LEDs, the LEDs being connected in series with each other and with at least one current limiting resistor, the two ends of the string of the serially connected LEDs electrically connected to the copper stranded wires in the core line;

a diffuser, the diffuser being a milky translucent object with the same length as the core line and with predetermined height and width and provided above the plurality of LEDs for scattering the light beams of the LEDs;

a cladding layer with the same length as the core line, the cladding layer being formed of white opaque flexible plastic by extrusion molding for wrapping the core line, the diffuser and the plurality of LEDs, the cladding layer being a semi-circular surface simulating the tube light emitting surface of neon light, the cladding layer being formed integrally with the diffuser into one piece;

wherein a unit is formed by disposing a red LED, a green LED and a blue LED of the plurality of LEDs into a fixing means, a plurality of the units are connected in series and disposed in the plurality of transversal through-holes of the core line respectively.

The transversal through-hole is quadrate, circular or elliptical in shape.

The fixing device can be a box. The box is quadrate, circular or elliptical in shape. The box is provided with an opening on the top and an opening at the bottom, the opening at the bottom is slightly larger than that on the top. The box is provided with a clasp plate and a clasp key at the bottom for closing over the LED. The box is provided with slots for leading out the LED lead wires on the two sides of the bottom. The clasp plate is provided with a clapboard for supporting the LED and separating the two LED lead wires.

With the present invention, the improved color changeable tube light is of the following advantages:

Due to the fact that a unit is formed by disposing a red LED, a green LED and a blue LED of the plurality of LEDs into a fixing means and a plurality of the units are disposed in the transversal through-holes of the core line respectively, the tube light is of compact and firm the structure, and the LED lead wire is not broken easily, the electrical connection is stable, the three LEDs are not dislocated, the spacing between the three LEDs is small, which is beneficial for the color changing and mixing of the red, green and blue LEDs, so that the tube light according to the present invention is of the effects of successive, even, bright-color and soft light beams and can be bended freely and cut off or extended if necessary. The changing and flashing of seven colors and the variety and floweriness of color can be obtained accordingly.

DETAILED DESCRIPTION OF THE INVENTION

Figures 1, 2:
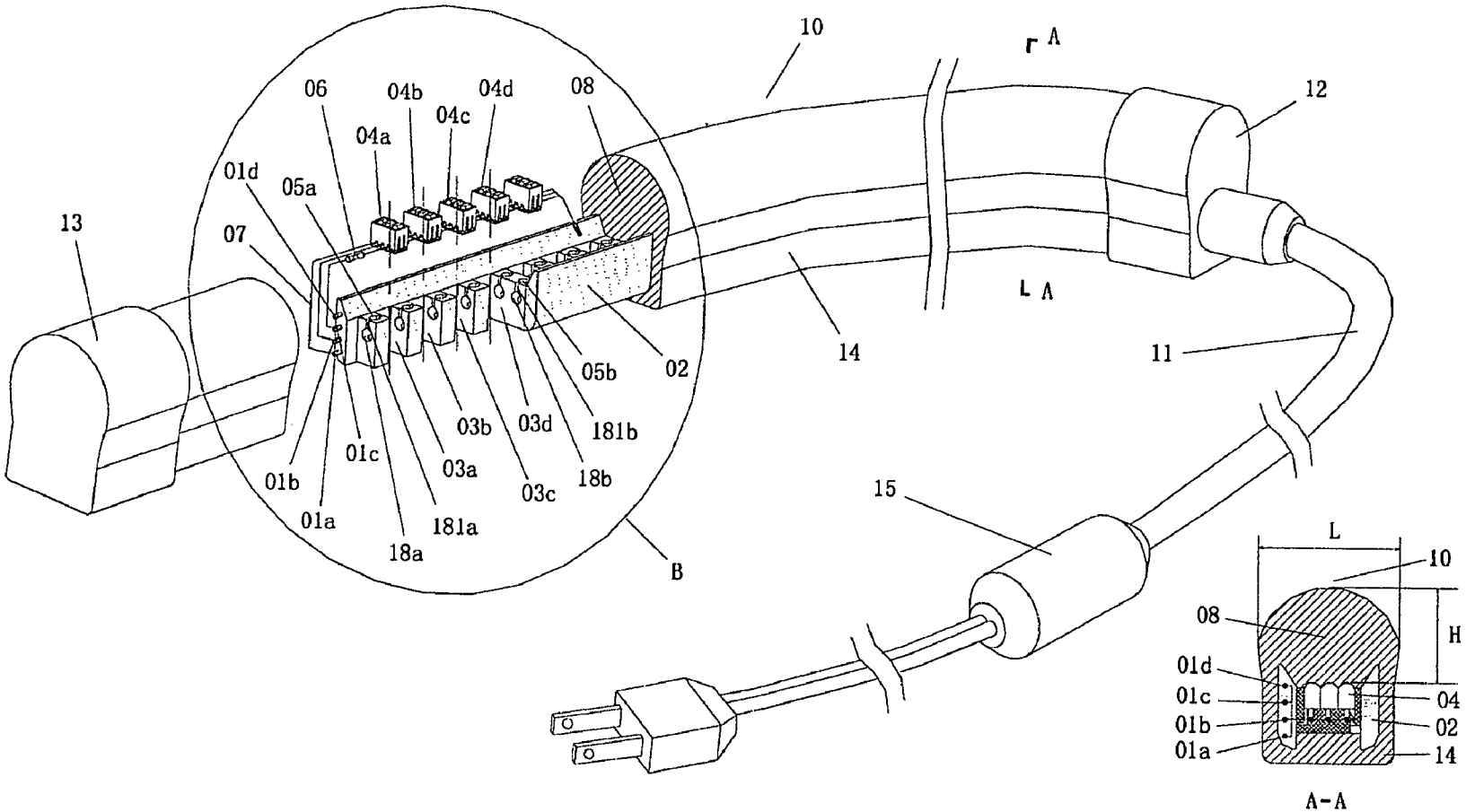
FIG. 1 is a perspective view of a tube light according to an embodiment of the present invention.
FIG. 2 is a cross-sectional view of the tube light shown in FIG. 1 taking from A-A line.
Figure 3:
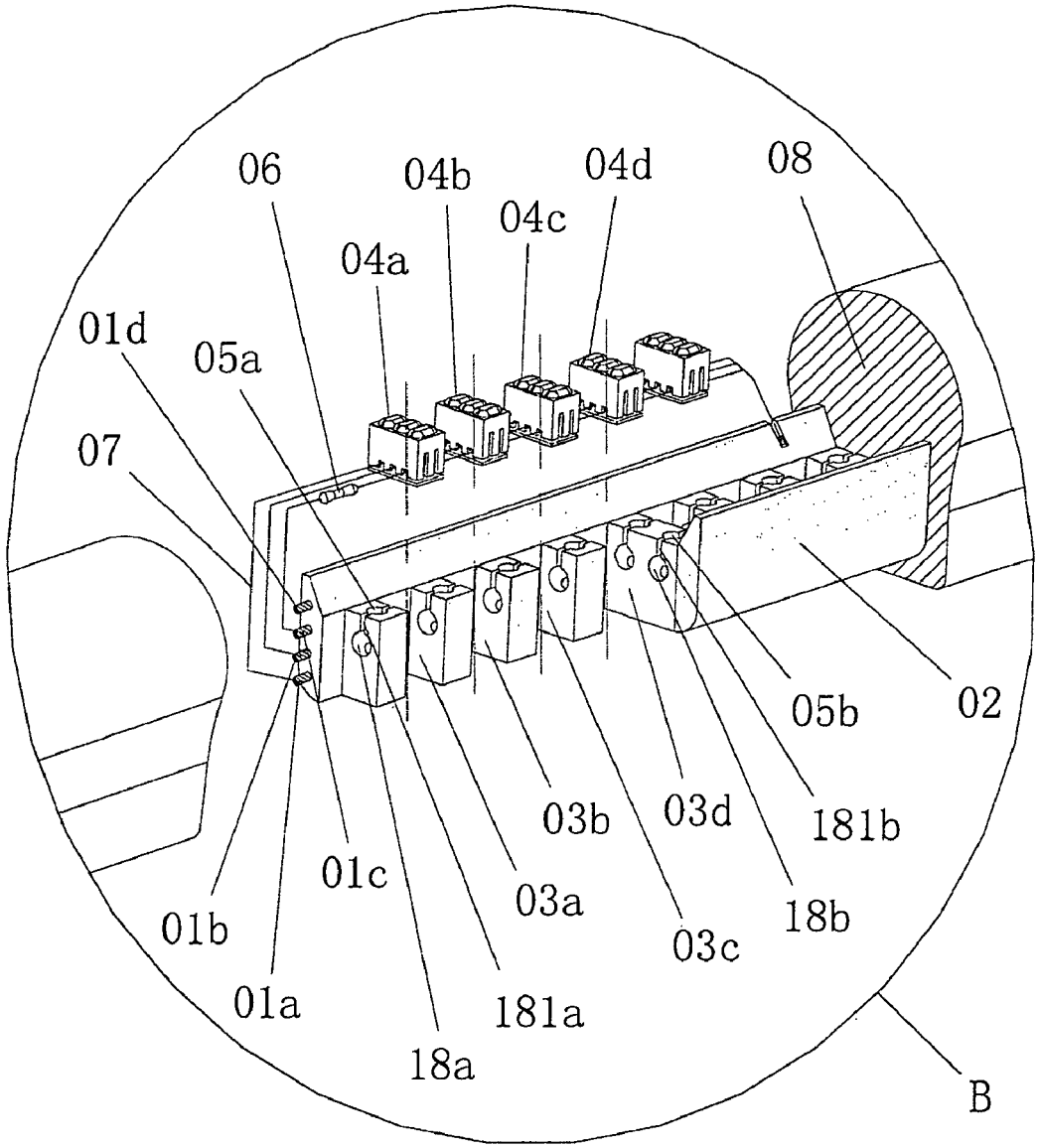
FIG. 3 is a detailed view of the "B" section of FIG. 1.

Referring to FIG. 1, FIG. 2 and FIG. 3, in the production process of an improved color changeable tube light, four copper stranded wires 01*a*, 01*b*, 01*c* and 01*d* pass through the molding hole (not shown) of the extrusion molding machine, a strip with predetermined length made of white opaque flexible plastic such as PVC or plastic with other color is automatically and successively extruded. The strip is provided with a groove of reverse trapezoidal shape. The strip is the core line 02. In the middle part of the core line 02, two longitudinal through holes 18*a* and 18*b* are arranged horizontally at interval. The copper stranded wires 01*a*, 01*b*, 01*c*, 01*d* and the longitudinal through holes 18*a*, 18*b* extend longitudinally along the strip and have the same length as the core line 02. Slots 181*a*, 181*b* are formed longitudinally on the upper side wall of the longitudinal through holes 18*a*, 18*b* respectively.

Then, along the whole longitudinal length of the core line 02, a plurality of transversal through holes 03*a*, 03*b*, 03*c*, 03*d*, 05*a* and 05*b* parallel with the copper stranded wires 01*a*, 01*b*, 01*c* and 01*d* are punched at even interval by automatic punching machine. The interval through holes are arranged in the middle part of the core line 02 on the side opposite to that of the copper stranded wires 01*a*, 01*b*, 01*c* and 01*d* and parallel to the copper stranded wires 01*a*, 01*b*, 01*c* and 01*d*. The punched lateral though holes on the core line are of at least one row, and may be two rows, three rows etc. The lateral through hole may be quadrate, circular or elliptical or other in shape. In this embodiment, the transversal through holes 03*a*, 03*b*, 03*c*, 03*d* are quadrate, and the other two rows of the lateral through holes 05*a*, 05*b* are round.

LED bulb is of the good properties such as low energy consumption, low temperature, high brightness and small size, and thus the spacing between the LEDs can be reduced to increase the number of LEDs per unit length, so that the brightness of tube light can be improved safely, and it is possible to obtain the brightness which exceeds that of the glass neon light. Preferably, the LED bulb is elliptical or flat in shape and has a diameter or width of 3 mm to 5 mm, and the brightness of LED is around 200 Mcd, and the spacing between the transversal through holes 03*a*, 03*b*, 03*c* and 03*d* for containing the LEDs is only ½ inch.

Figure 6:
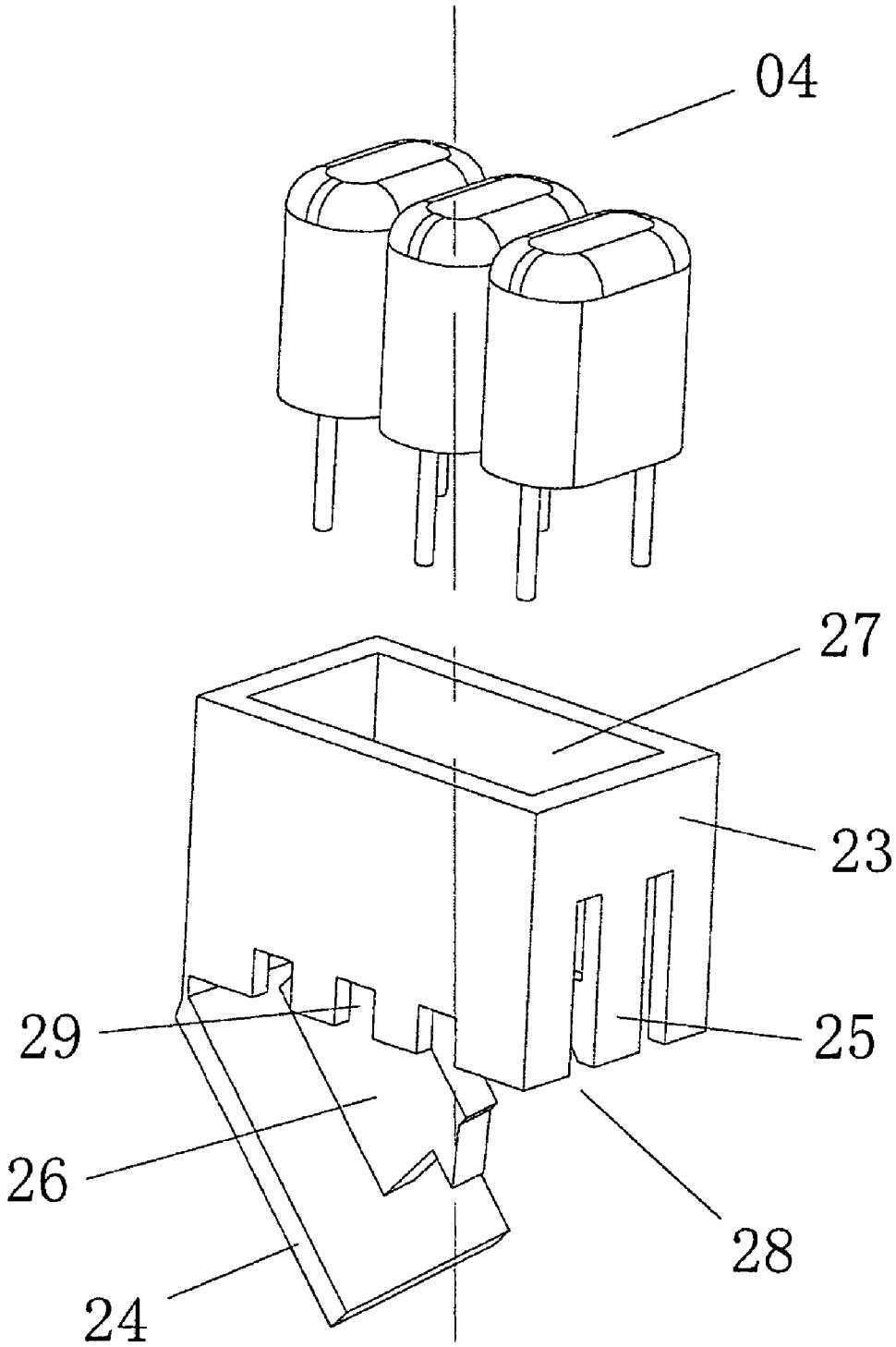
FIG. 6 is an exploded view of a quadrate box as the fixing means according to an embodiment of the present invention.
Figure 7:
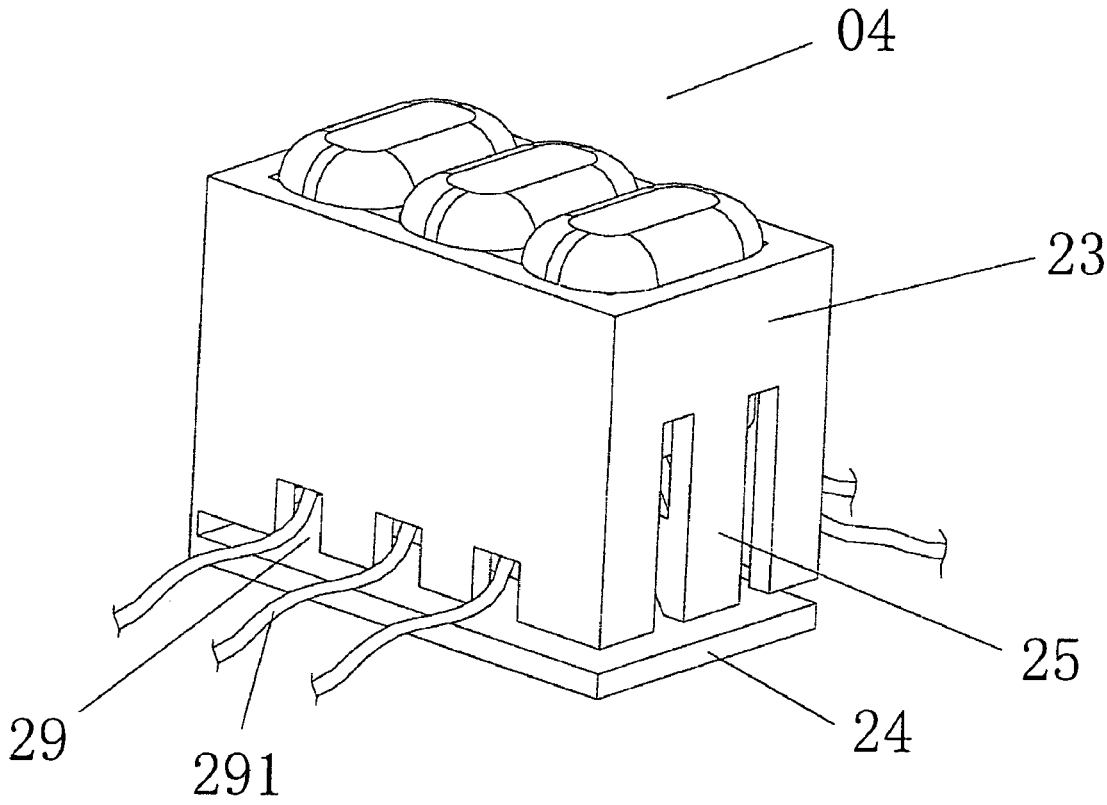
FIG. 7 is an assembly view of a quadrate box as the fixing means according to an embodiment of the present invention.

In the present invention, a unit is formed by disposing a red LED, a green LED and a blue LED of the plurality of LEDs into a fixing means, a plurality of the units are connected in series and disposed in the plurality of transversal through-holes of the core line respectively. The box is quadrate, round or elliptic in shape. As shown in FIG. 6, FIG. 7, the fixing means is preferably implemented in the form of the quadrate box 23, which can prevent the breaking of LED lead wire and enable the structure compact and firm. The quadrate box 23 is provided with an opening on the top 27 and an opening at the bottom 28, the opening at the bottom 28 is slightly larger than the opening on the top 27. A clasp plate 24 and a clasp key 25 for closing over the LED is provided at the bottom of the quadrate box 23. The clasp plate 24 is provided with a clapboard 26 for supporting the LED and separating the two LED lead wires. The box 23 is provided with slots 29 for leading out the LED lead wires on the two sides of the bottom. The LED bulb 04, that is the three LEDs of red, green and blue, is inserted into the quadrate box 23 via the bottom 28, and then the clasp plate 24 is covered, and thus the clapboard 26 exactly supports the LEDs and separates the two lead wires of LEDs. The lead wires 291 are guided out of the quadrate box through the slots 29. The clasp plate 24 and the clasp key 25 snap together, so that the firm and compact structure is obtained and the breaking of the two LED lead wires can be avoided, as shown in FIG. 7.

After the core line 02 is produced, the quadrate boxes 04*a*, 04*b*, 04*c* and 04*d* each of which contains the three LEDs of red, green and blue are connected in series according to the color, that is, red LEDs are connected with each other into one route, green LEDs are connected with each other into one route, and blue LEDs are connected with each other into one route. At least one current limiting resistor 06 is connected in series with the LEDs. The quadrate boxes 04*a*, 04*b*, 04*c* and 04*d* are inserted into the quadrate transversal through-holes 03*a*, 03*b*, 03*c*, 03*d* of the core line 02 respectively in sequence. Two round transversal through-holes 05*a*, 05*b* for containing the wires connecting the LEDs or the serially connected current limiting resistor 06 are arranged between two quadrate transversal through-holes. The lead wires 291 of the LEDs 04 and the connection wires thereof are disposed in the longitudinal through holes 18*a*, 18*b* via the slots 181*a* and 181*b*. After the LED string is inserted into the core line 02, the lead wires 07 of the head end of the LED string are connected to the copper stranded wires 01*a*, 01*b*, 01*c* and the other end of the LED string is connected to the copper stranded wire 01*d*, so that three loop are formed, as shown in FIG. 3.

Figure 8:
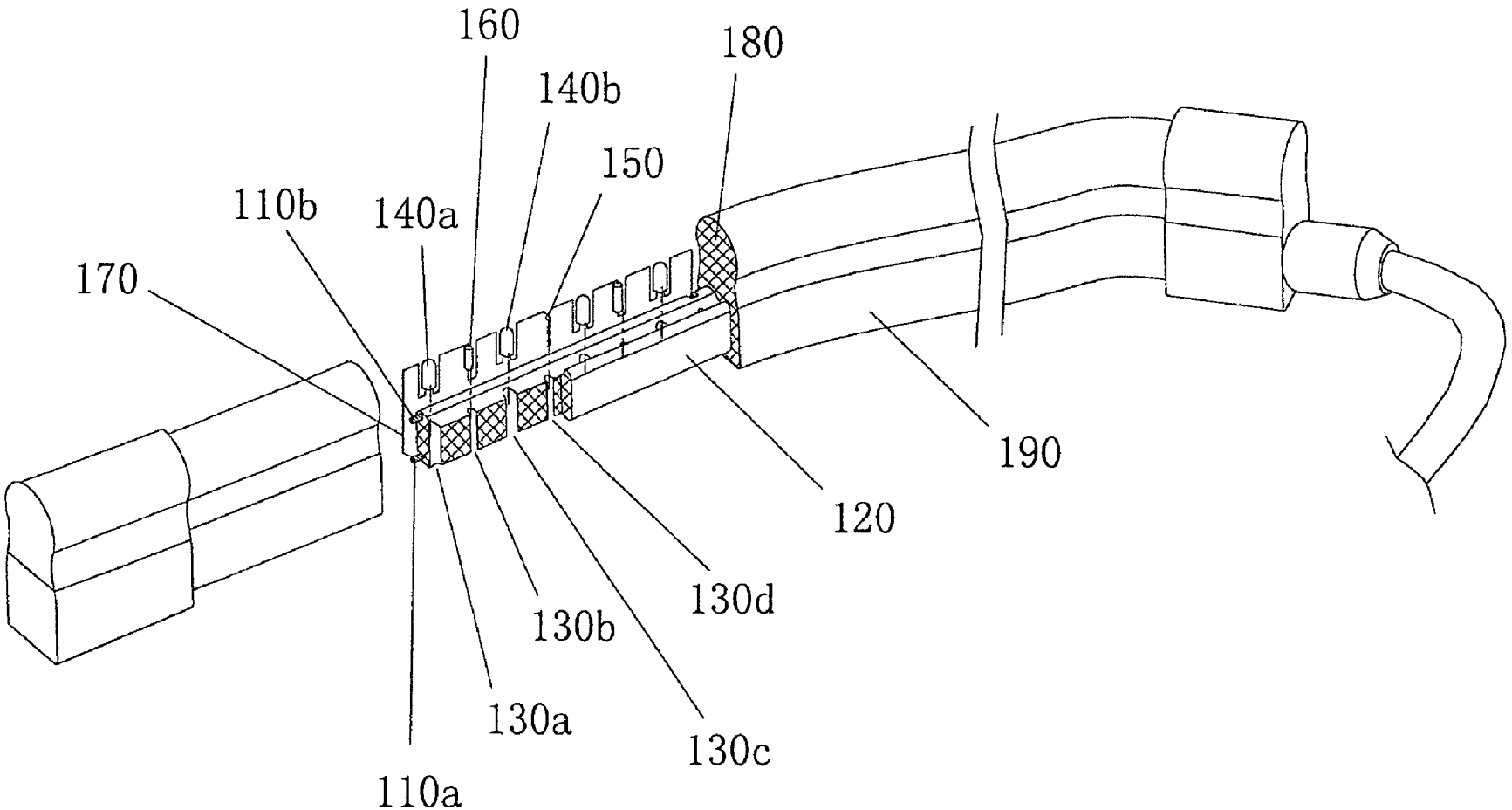
FIG. 8 is a perspective view of the known tube light in the art.

As shown in FIG. 8, the known tube light is formed of a core line 120 covered with a diffuser 180 and a light shield layer 190. The copper stranded wires 110*a*, 110*b* are provided up and down on one side of the cross section of the core line 120 at interval, and the LEDs 140*a*, 140*b* are provided on the other side opposite to the copper stranded wires 110*a*, 110*b*. The LEDs 140*a*, 140*b*, the connection wire 150 and the current limiting resistor 160 are inserted into the transversal through-holes 130*a*, 130*b*, 130*c* and 130*d* of the core line 120. The fixing means is not used, and the LEDs 140*a*, 140*b* are inserted into the transversal through-holes directly.

Figure 4:
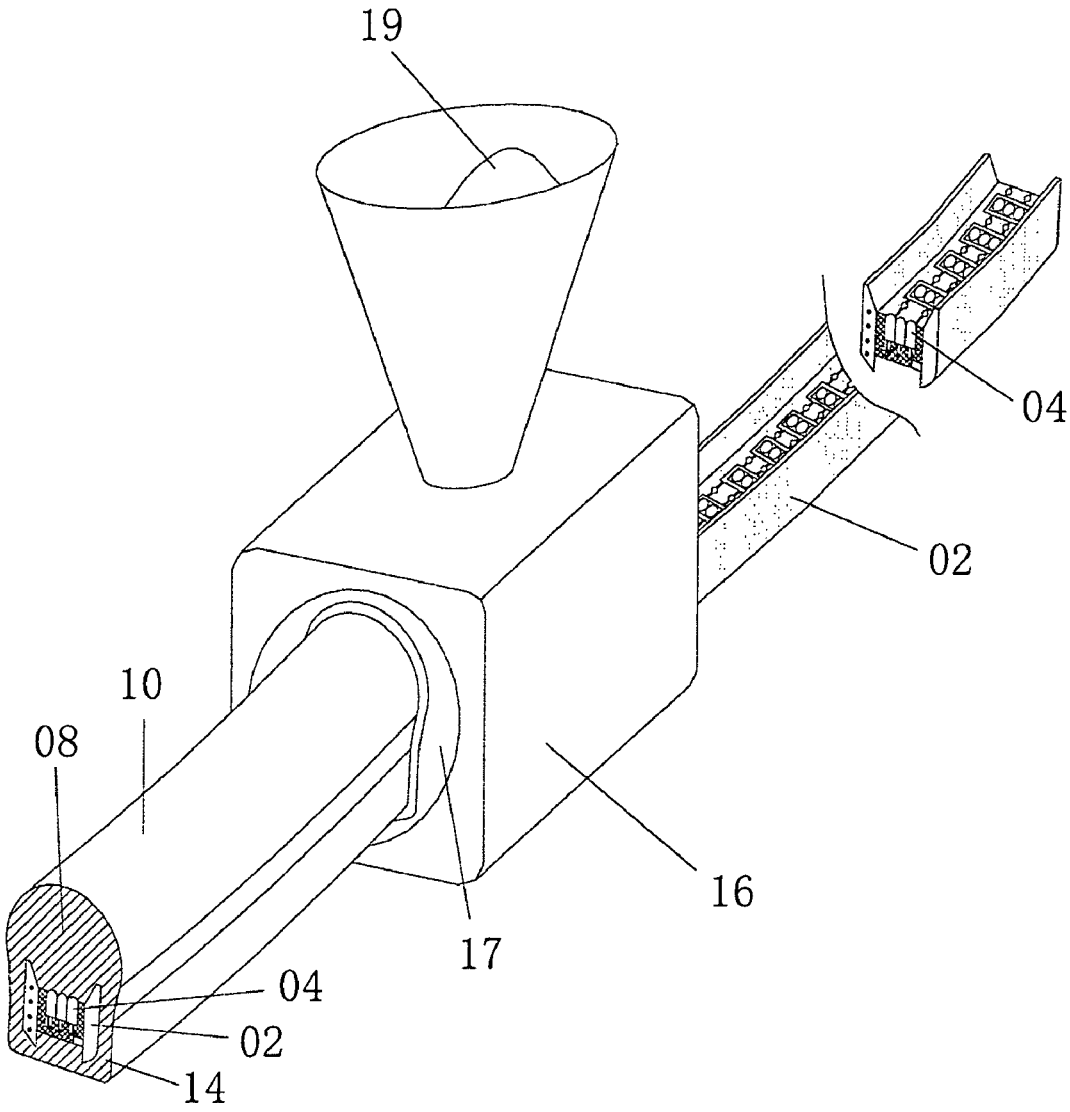
FIG. 4 is a schematic view of extrusion molding of a tube light according to an embodiment of the present invention.

After the above LED string is completely inserted into the core line 02, the core line 02 is pulled through the molding hole 17 of the extrusion molding machine 16, as shown in FIG. 4, a cladding layer 14 with the same length as the core line 02 for covering the core line 02 is formed automatically by extrusion molding of flexible plastic 19. The diffuser which is a milky translucent object is automatically and successively extruded integrally with the cladding layer 14. The diffuser is of the same length as the cladding layer 14. That is, when the core line 02 passes through the extrusion molding machine, the diffuser 08 is formed above the core line 02, the cladding layer 14 is formed below the core line 02, and the diffuser 08 and the cladding layer 14 are extruded simultaneously in one piece by extrusion molding. The plastic 19 for molding the diffuser 08 and the cladding layer 14 is milky translucent flexible plastic normally PVC. The diffuser 08 is above the LED bulb 04, and is semi-circular surface 10 for simulating the tube light emitting surface of neon light. The diffuser 08 above the core line 20 is 14 mm in height and 27 mm in width, as shown in FIG. 2.

It is known to the skilled in the art that when the core line 02 passes through the molding hole 17 of the molding machine 16, the diffuser 08 should be disposed on right above the LED bulb 04 in the core line 02, that is, the LED bulb 04 should be disposed on right below the diffuser 08 and close to the midline of the diffuser 08.

Because the core line 02 is made of opaque plastic, the emission light of LED will not penetrate the two side walls of the core line 02 after the LEDs are disposed in the quadrate transversal through-holes of the core line. The opaque core line 02 performs the function of shielding the emission light from the sides of LEDs 04, so that light beams are only emitted from the top of the LEDs 04 and then emitted outwards through the diffuser 08.

Figure 5:
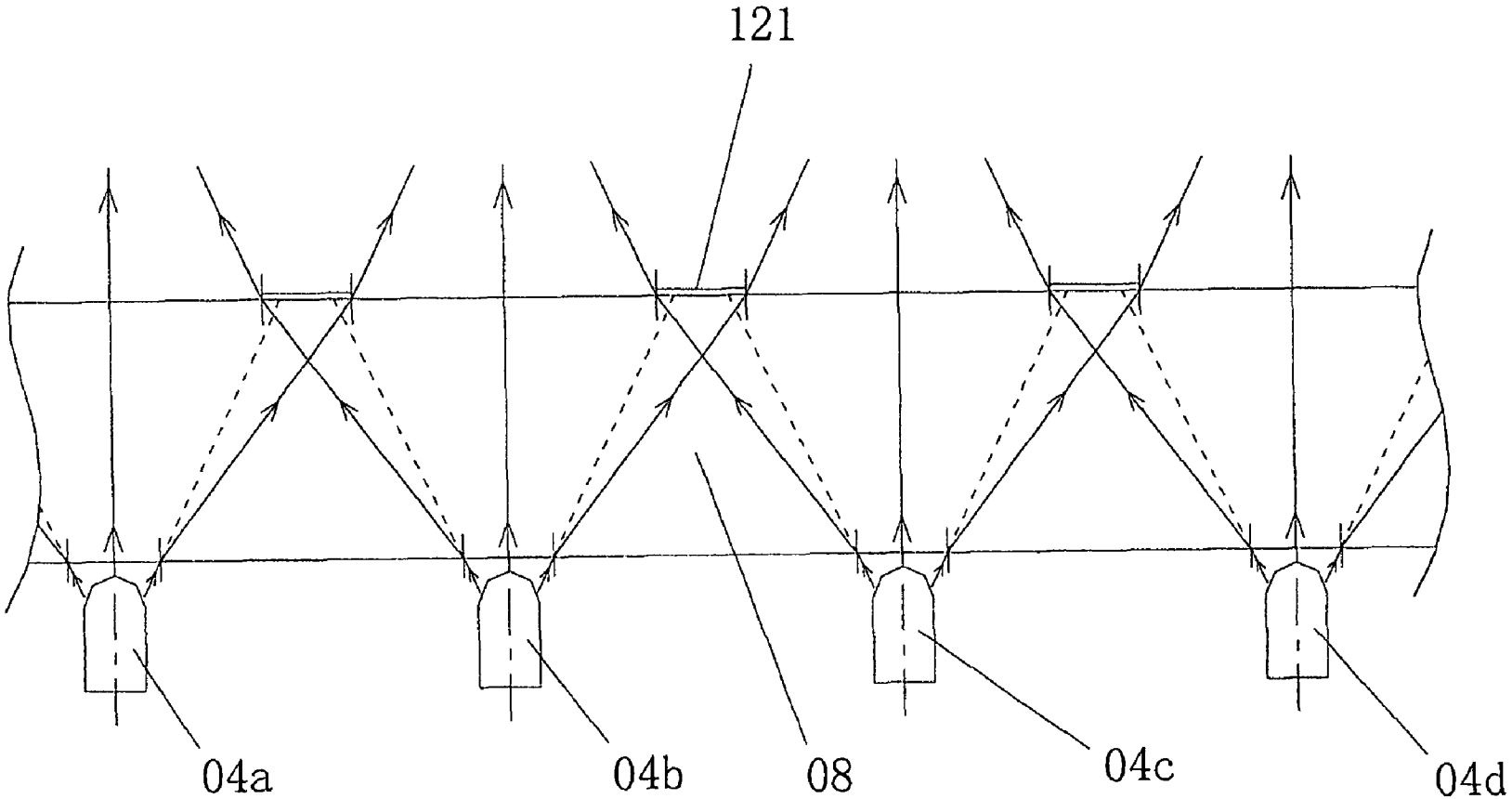
FIG. 5 is a schematic principle diagram of optics of a tube light according to an embodiment of the present invention.

The diffuser 08 of the improved color changeable tube light according to the present invention is a milky translucent or foggy translucent object, and normally made of milky flexible PVC or Acrylic by extrusion molding. The width and height of the diffuser 08 is correlative to the brightness and the irradiation angle of LEDs in the core line. The height and width of the diffuser may be larger if the brightness and the irradiation angle of LEDs is large. In contrary, the height and width of the diffuser should be smaller if the brightness and the irradiation angle of LEDs are small. The larger the width and height of the diffuser, the more loss in brightness, and the better in eliminating the appearance of the spot light source. In contrary, the smaller the width and height of the diffuser, the weaker in eliminating the appearance of the spot light source, and the higher in brightness. It is preferred to the present invention that the diameter or the width of a LED is 3-5 mm, the brightness of LED is around 200 Mcd, the irradiation angle of a LED is 45 degree, and the spacing between the quadrate lateral through holes on the core line 02 for containing the quadrate boxes of LEDs is ½ inch. The diffuser 08 is of a height H of 14 mm and a width L of 27 mm, as shown in FIG. 2. The emission light of LED is diffused and refracted by the diffuser 08, and the light beams of LED 04*a*, 04*b*, 04*c*, 04*d* overlap at edge sections, for example, the emission light beams of LED 04*b*, 04*c* overlap at section 121, so that the brightness at edge sections of LEDs is enhanced and nearly equivalent to that at central sections of LEDs, as shown in FIG. 5. Therefore, the appearance of tube light according to the present invention has the effect of successive and even light beams similar to that of the neon light.

After the above-mentioned cladding layer is formed, the copper stranded wires 01*a*, 01*b*, 01*c*, 01*d* should be electrically connected to the power supply wire 11 and a plastic casing is provided for protecting the electrical connection, and thus a connector 12 is formed, as shown in FIG. 1. Meanwhile, a plastic casing, that is, a tail plug 13 for encapsulating the copper stranded wire and the electrical connection wire thereof is formed on the end of the above-mentioned core line 02 and the cladding layer 14. It is known to those skilled in the art that a plurality of methods for implementing the electrical connection and the plastic casing for protecting the electrical connection have been available.

The structure of the core line of the improved color changeable tube light according to the present invention is shown in FIG. 1, FIG. 2 and FIG. 3. The core line 02 is provided with a groove on the side facing the top of the LED bulb 04, and the groove is reverse trapezoidal in shape. The two inclined surfaces of the trapezoid concentrate and reflect the light beams emitted by the LEDs 04 in the core line 02, so that it appears from the above of the semi-circular surface that the brightness is higher and the effects of successive, even, bright-color light beams are better. In addition, a layer of phosphor may be provided on each of the inclined surfaces of the groove in the core line 02 so as to obtain a more flowery appearance of light beams.

Figure 9:
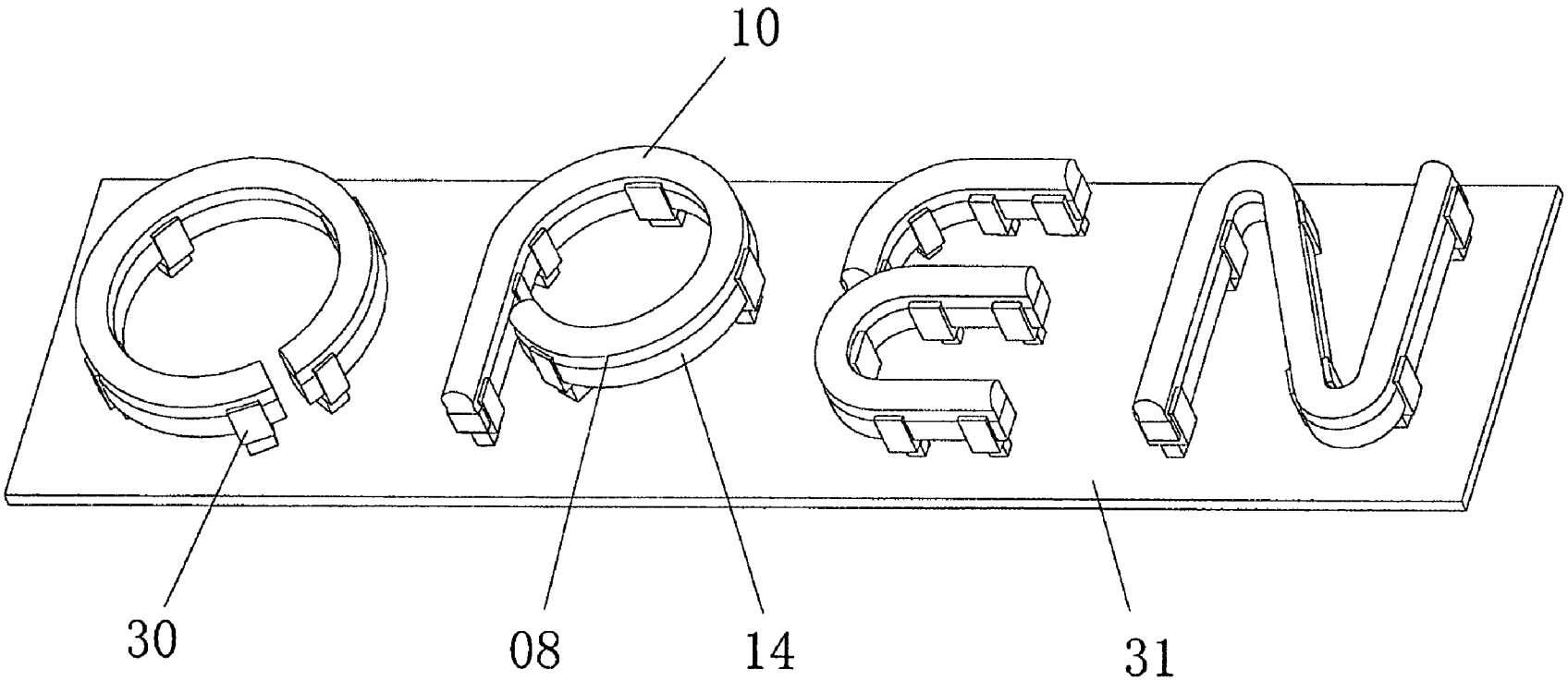
FIG. 9 is an example of using the tube light according to an embodiment of the present invention.

As shown in FIG. 9, a light board displaying the word "OPEN" is formed by using the tube lights according to the present invention, which simulate the neon light. During the assembly, the tube lights are cut off and bended so as to form the word "OPEN", and the tube lights are fixed to a board 31 by fixing means such as clamps 30. Therefore, the improved color changeable tube light of the present invention is of simple structure, and can be easily assembled, and is safe and reliable. Meanwhile, it is seen from the above of the semi-circular surface 10 that the tube light is of successive and even light beams, and the light beams from the sides of LEDs are shielded by the opaque core line so as to enable the word pattern formed by the tube light of the present invention to have the effects of light beams of neon light, and the color changing and the color mixing to obtain various effects are available.

What is claimed is:

1. An improved color changeable tube light, comprising:

a core line being formed of a strip with predetermined length produced by extrusion molding of white opaque flexible plastic, wherein four copper stranded wires are provided vertically in interval in one side portion of the cross section of the strip, two longitudinal through holes are provided at the middle portion of the cross section of the strip, the copper stranded wire is of the same length as that of the longitudinal through hole, a slot is formed longitudinally on the upper side wall of the longitudinal through hole, a plurality of transversal through-hole are arranged at predetermined even interval along the longitudinal length of the strip, each of the transversal through-hole parallel to the copper stranded wire is provided in the central of the strip, a reverse trapezoidal groove is provided on the upper side wall of the strip;

a plurality of LEDs being connected in series with each other and with at least one current limiting resistor, the two ends of the string of the serially connected LEDs being electrically connected to the copper stranded wires in the core line;

a diffuser being a milky translucent object with the same length as the core line and with predetermined height and width and provided above the plurality of LEDs for scattering the light beams of the LED;

a cladding layer with the same length as the core line, the cladding layer being formed of white opaque flexible plastic by extrusion molding for wrapping the core line, the diffuser and the plurality of LEDs, the cladding layer being a semicircular surface simulating the tube light emitting surface of neon light, the cladding layer being formed integrally with the diffuser into one piece;

wherein a unit is formed by disposing a red LED, a green LED and a blue LED of the plurality of LEDs into a fixing means, a plurality of the units are connected in series and disposed in the plurality of transversal through-hole of the core line respectively.

2. The improved color changeable tube light of claim 1, wherein the transversal through-hole is quadrate, circular or elliptical in shape.

3. The improved color changeable tube light of claim 1, wherein the fixing device is a box.

4. The improved color changeable tube light of claim 3, wherein the box is quadrate, circular or elliptical in shape.

5. The improved color changeable tube light of claim 4, wherein the box is provided with an opening on the top and an opening at the bottom, the opening at the bottom is slightly larger than that on the top.

6. The improved color changeable tube light of claim 4, wherein the box is provided with a clasp plate and a clasp key at the bottom for closing over the LED.

7. The improved color changeable tube light of claim 6, wherein the clasp plate is provided with a clapboard for supporting the LED and separating the two LED lead wires.

8. The improved color changeable tube light of claim 4, wherein the box is provided with slots for leading out the LED lead wires on the two sides of the bottom.

* * * * *